US005449304A

United States Patent [19]

Huss, Jr. et al.

[11] Patent Number: 5,449,304

[45] Date of Patent: Sep. 12, 1995

[54] ELECTRICAL CONNECTOR HAVING IMPROVED CONTACTS

[75] Inventors: John P. Huss, Jr., Harrisburg; George H. Douty, Mifflintown, both of Pa.

[73] Assignee: The Whitaker Corporation, Wilmington, Del.

[21] Appl. No.: 245,948

[22] Filed: May 19, 1994

[51] Int. Cl.[6] ..... H01R 13/187

[52] U.S. Cl. ..... 439/843; 439/825

[58] Field of Search ..... 439/842–848, 439/851–856, 861, 839, 825–827

[56] References Cited

U.S. PATENT DOCUMENTS

| | | | |
|---|---|---|---|
| 3,573,722 | 4/1971 | DeLano | 439/825 |
| 3,861,595 | 1/1975 | Deal | 339/95 R |
| 3,861,776 | 1/1975 | Deal | 339/74 R |
| 4,013,329 | 3/1977 | Hugin | 339/9 E |
| 4,080,033 | 3/1978 | Deal | 339/95 R |
| 4,191,445 | 3/1980 | Deal | 339/252 R |
| 4,655,526 | 4/1987 | Shaffer | 439/851 |
| 4,752,253 | 6/1988 | Neumann et al. | 439/825 |
| 4,753,616 | 6/1988 | Molitor | 439/825 |
| 4,810,213 | 3/1989 | Chabot | 439/825 |
| 4,822,961 | 4/1989 | Hugin et al. | 200/16 R |
| 5,015,195 | 5/1991 | Piriz | 439/825 |
| 5,078,622 | 1/1992 | Hunt III et al. | 439/589 |

FOREIGN PATENT DOCUMENTS

| | | | |
|---|---|---|---|
| 2502632 | 7/1976 | Germany | 439/825 |

*Primary Examiner*—David L. Pirlot

[57] ABSTRACT

A stamped and formed electrical contact (34, 100) is disclosed for use in an electrical connector (30). The contact includes a plurality of retention features (66, 68, 110, 116) for securing a band contact element (42, 104) thereto. Each retention feature consists of a protrusion (66, 68, 110, 116) extending from the surface (64, 105) of the contact body (40, 102) and having an abutting wall (74, 78, 120, 122) facing the band contact element. The protrusions are equally spaced about the longitudinal axis (70, 112) of the contact body and are arranged in two groups, one group adjacent the end (62, 114) of the contact body and the other group spaced from the first group so that the band contact element fits between the opposing abutting walls of the two groups of protrusions. The protrusions are formed during the stamping process of the contact body.

18 Claims, 5 Drawing Sheets

Fig. 3
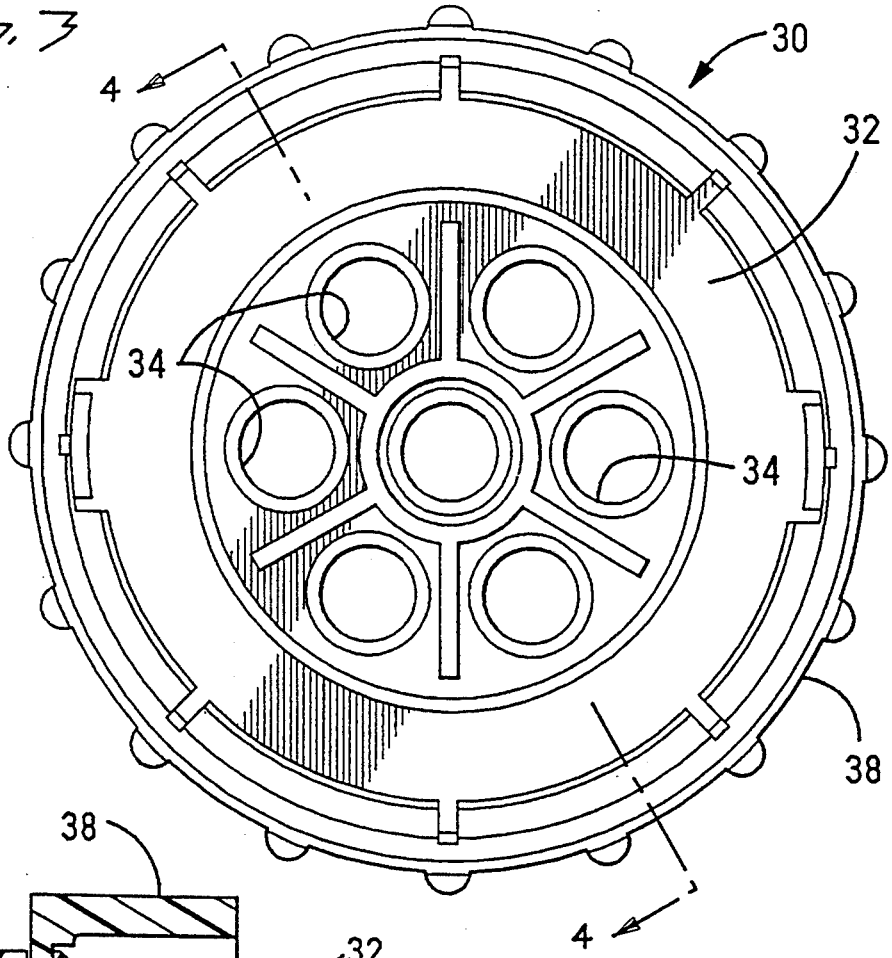
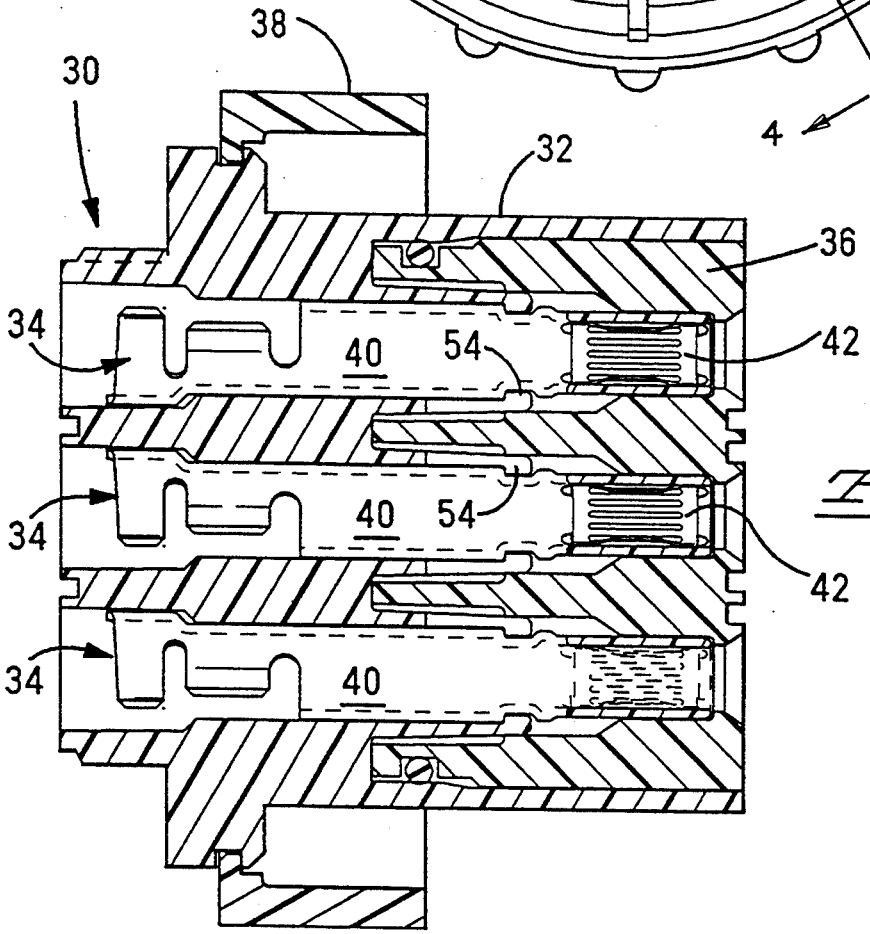
Fig. 4

ELECTRICAL CONNECTOR HAVING IMPROVED CONTACTS

The present invention relates to electrical connectors having contacts including separate band contact elements that are held in place by means of retention features formed on the body of the contact.

BACKGROUND OF THE INVENTION

Electrical connector contacts utilizing separate band contact elements necessarily have very precisely shaped retaining and locating surfaces for positioning and securing the band element to the body of the contact. Such contacts are generally machined in a screw machine so that the necessary precision can be achieved. An example of such a contact is the Contact Socket Assembly manufactured under part number 93-1813-66 by AMP Incorporated of Harrisburg Pa., and which is shown in FIG. 1. There, the contact assembly 10 includes a contact body 12 and a band contact element 14, which is manufactured by AMP Incorporated under the trade name LOUVERTEC. An enlarged view of the end of the contact body 12, with the band contact element removed, is shown in FIG. 2. The contact body 12 includes an inner diameter 16 having a first abutting shoulder 18 at one end thereof and a second abutting shoulder 20 adjacent the free end thereof. The band contact element 14 is inserted into the diameter 16 by urging it against a chamfer 22 formed on the end of the contact body so that the band 14 closes down until it passes through a reduced diameter 24. The band contact element 14 then snaps outwardly to electrically engage the inner diameter 16 of the contact body 12 and is trapped between the two abutting shoulders 18 and 20. Such a machined structure is very effective, especially in cases where the contact body is of substantial bulk to carry relatively high currents. However, these machined contacts are quite expensive to manufacture. What is needed is a contact body that is manufactured by less expensive stamping and forming means yet includes suitable retaining means for receiving and securing the band contact element to the contact body.

SUMMARY OF THE INVENTION

An electrical connector is disclosed having an electrical contact including a stamped and formed contact body with a plurality of retention features stamped and formed therein. A band contact element is in electrical engagement with a first surface of the contact body and is held captive thereto by the retention features. Each of the retention feature includes a protrusion extending from the first surface and having an abutting wall facing the band contact element and an opposite wall facing away therefrom.

DESCRIPTION OF THE FIGURES

FIG. 3 is an end view of a connector having socket contacts incorporating the teachings of the present invention;

FIG. 4 is a cross-sectional view taken along the lines 4—4 in FIG. 3;

DESCRIPTION OF THE PREFERRED EMBODIMENT

Figure 1:
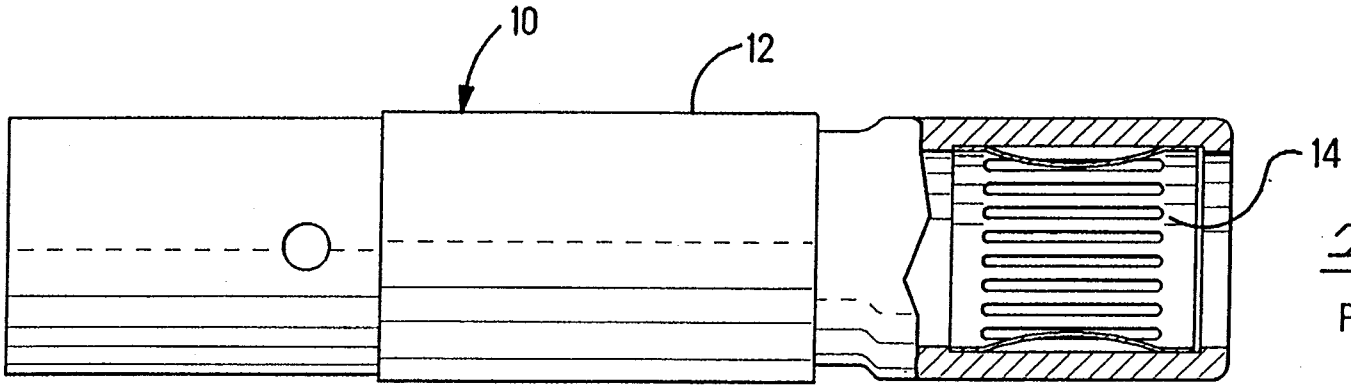
FIG. 1 PRIOR ART
FIG. 1 is a plan view of a prior art contact showing a partial cross-sectional area.
Figure 2:
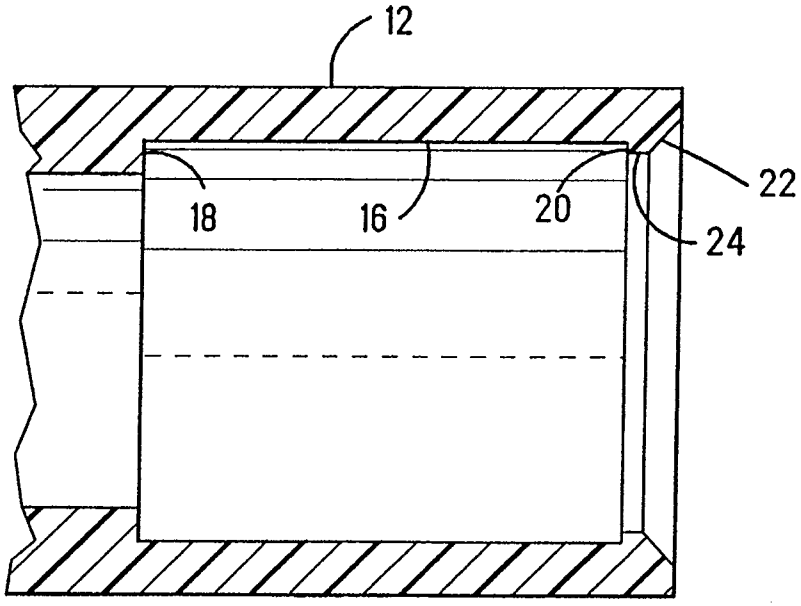
FIG. 2 PRIOR ART
FIG. 2 is an enlarged view of the cross sectioned portion of FIG. 1.

There is shown in FIGS. 3 and 4 a connector 30 having a housing 32, a plurality of socket contacts 34 disposed in the housing, and a retainer 36 arranged to lock the contacts in position within the housing. A locking ring 38 is arranged within a groove in the housing 32 so that it can rotate with respect thereto and has internal features that mate with and secure the connector 30 to a mating connector, not shown, having pin contacts that mate with the socket contacts 34.

Figure 6:
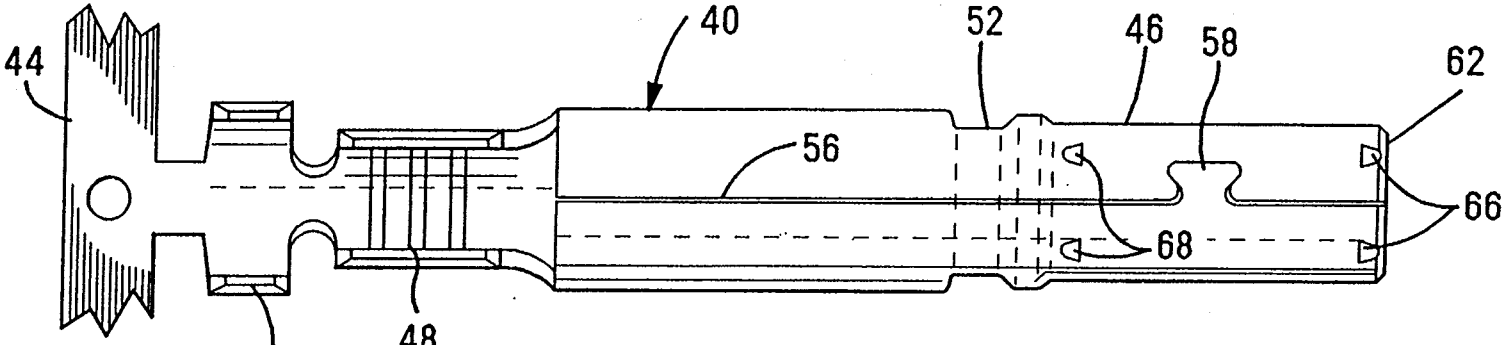
FIGS. 5, 6, and 7 are front,top, and end views, respectively, of a socket contact utilized in the connector shown in FIG. 3.
Figure 7:
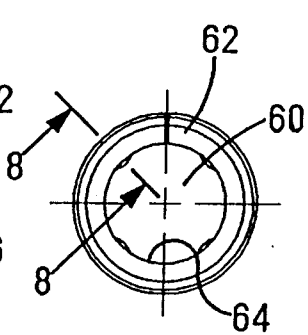
Figure 5:
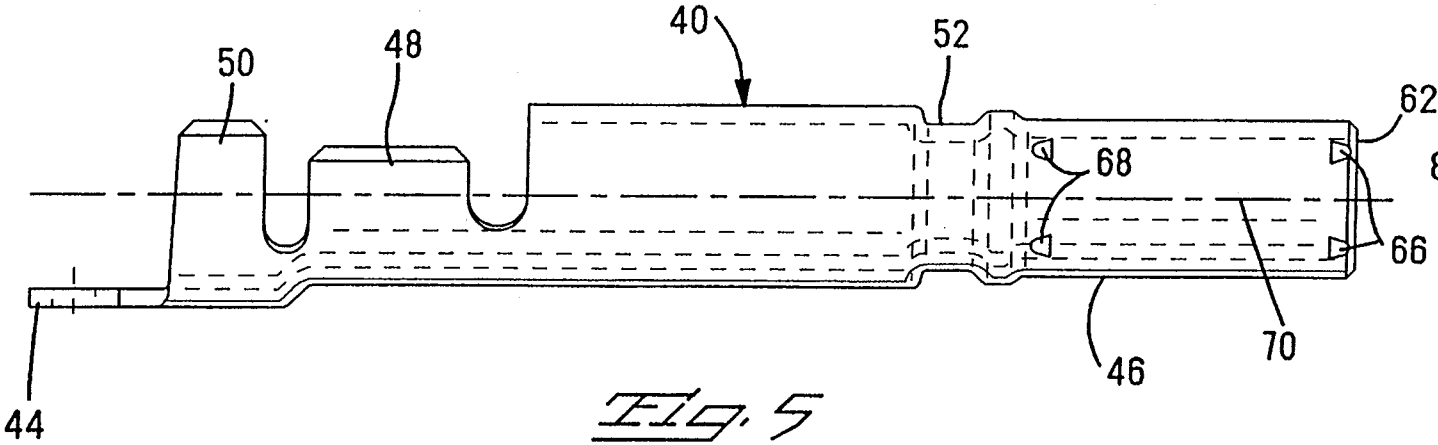

The socket contact 34 includes a contact body 40 and a LOUVERTEC band contact element 42 that is of cylindrical shape. The contact body 40, as shown in FIGS. 5, 6, and 7, is stamped and formed from a strip 44 of copper or some other suitable contact material in the usual manner. The contact body 40, after stamping, is rolled to form a barrel portion 46 at one end thereof and formed with wire and insulation crimping tabs 48 and 50, respectively, at the opposite end. The barrel portion 46 includes a recess 52 for receiving the arms 54 of a collet that functions in cooperation with the retainer 36 to retain the socket contacts 34 within the housing 32, as shown in FIG. 4. As best seen in FIG. 6, the barrel portion 46 has a seam 56 where opposite edges of the stamped contact body abut. The edges are secured together by means of a dovetail 58 so that the barrel retains its cylindrical shape. The barrel portion 46 has an axially disposed opening 60 at one end 62 thereof having an internal diameter or surface 64 that is sized to receive the band contact element 42.

Figure 8:
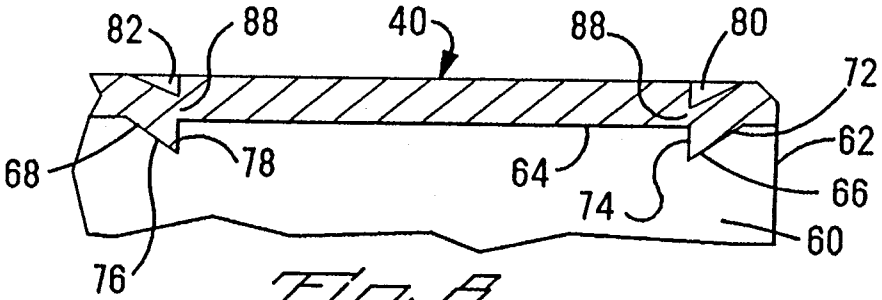
FIG. 8 is a partial cross-sectional view taken along the lines 8—8 in FIG. 7.
Figure 10:
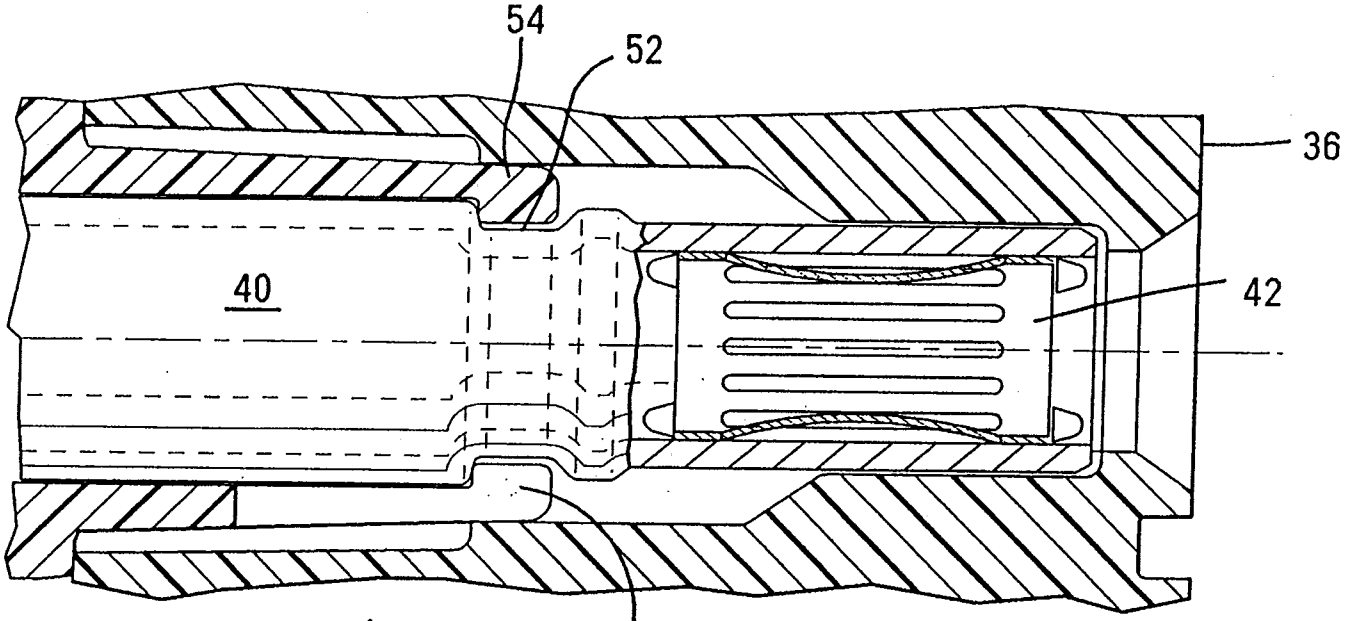
FIG. 10 is an enlarged view of a portion of one of the contacts shown in FIG. 4.

Retention features, including four protrusions 66 and four protrusions 68, are arranged to hold the band contact element 42 within the opening 60. The protrusions 66 and 68 are equally spaced about the longitudinal axis 70 of the contact body 40 and extend from the surface 64 inwardly toward the axis, as best seen in FIGS. 5, 6, and 7. The four protrusions 66 are adjacent the end 62 while the protrusions 68 are spaced a sufficient distance from the protrusions 62 so that the band contact element 42 will fit therebetween. As shown in FIG. 8, each of the protrusions 66 has an inclined surface 72 that extends away from the surface 64 in a direction toward the protrusions 68, and terminates in a vertical or near vertical wall 74. Each of the protrusions 68, as shown in FIG. 8, has an inclined surface 76 that extends away from the surface 64 in a direction toward the protrusions 66, and terminates in a vertical or near vertical wall 78. The vertical walls 74 and 78 are spaced so that the band contact element will fit between the walls and engage the surface 64, as best seen in FIG. 10, with a small amount of end play to accommodate a slight expansion of the band contact element when the socket contact is mated with a pin contact.

When assembling the band contact element 42 to the contact body 40, the band contact element is inserted into the opening 60 and urged toward and past the protrusions 66 so that the band contact element rides up the inclined surfaces 72 thereby resiliently deflecting the outer periphery of the band contact element a slight amount. As the band contact element completely passes the protrusion 66 it enters into the area between the two vertical walls 74 and 78 and snaps outwardly against the surface 64 in electrical engagement therewith, being held captive between the two groups of walls 74 and 78. Alternatively, a separate funnel-like tool, not shown, may be used to slightly compress the band contact element so that it passes the protrusions 66 during insertion of the element into the opening 60.

Figure 9:
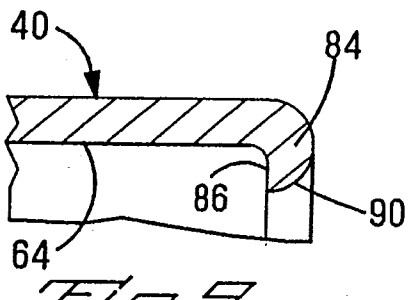
FIG. 9 is a view similar to that of FIG. 8 showing an alternative embodiment.

The protrusions 66 and 68 are made by forming indents 80 and 82 in the outer surface of the contact body 40 with a punch while supporting the inside surface 64 with a mating die, in the usual manner, to cause the protrusions to extend from the surface 64. This operation is most easily done during the stamping operation when the contact body is blanked from the flat strip stock 44 and prior to the rolling operation. The walls 74 and 78 may, if desired , be sheared completely through in the area indicated at 88 in FIG. 8, or the metal may simply be upset but remain contiguous. Other suitable stamping and forming operations may be employed to form the protrusions 66 and 68 that do not require the forming of the indentations 82. Such protrusions are considered within the scope of the present invention. The most important requirement is that the protrusions have near vertical opposing walls 74 and 78 and that the protrusions 66 have inclined surfaces 72 to aid in assembling the band contact element 42 to the contact body 40. An alternative to the protrusions 66 shown in FIG. 8 is a rolled edge 84, shown in FIG. 9, that can be formed to provide a near vertical wall 86 facing the walls 78 of the protrusions 68. The rolled edge 84 has a radiused portion 90 that serves as a lead in for the band contact element when assembling it to the contact body 40, in a manner similar to that of the inclined surface 72. In any case, each of the walls 74, 78, and 86 must be vertical or near vertical with respect to the surface 64. For example, in the present case the walls 74 and 78 are held to within about 15 degrees of vertical.

Figures 11, 12, 13, 14:
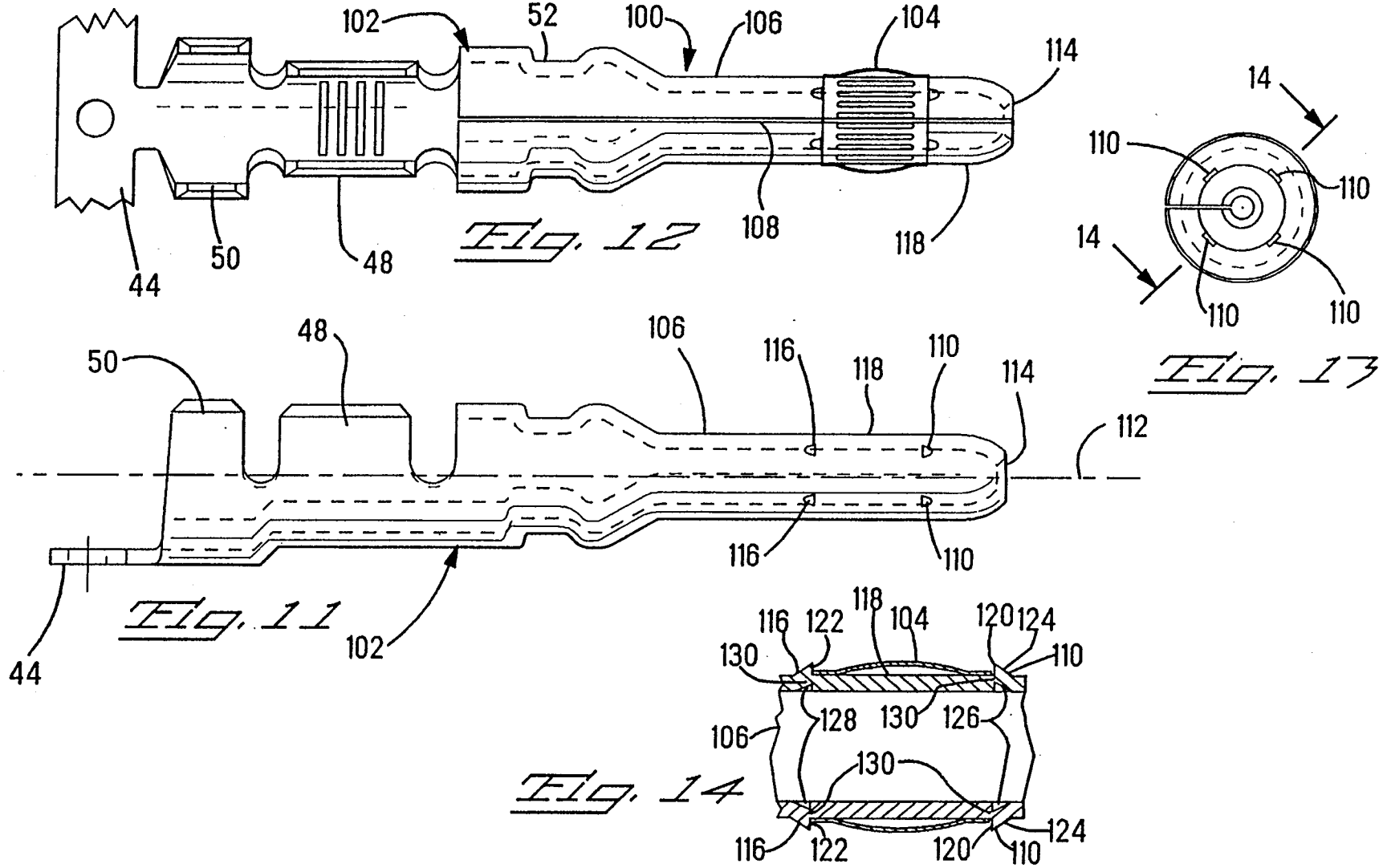
FIGS. 11, 12, and 13 are front, top, and end views, respectively, of a pin contact incorporating the teachings of the present invention and utilized in a connector for mating with a connector having socket contacts.
FIG. 14 is a partial cross-sectional view taken along the lines 14—14 in FIG. 13.

The above description discloses a socket contact having a band contact element that mates with a pin contact of a mating connector. However, the present invention may be advantageously utilized with a pin contact having a band contact element that mates with a cylindrical opening in a mating socket contact. There is shown in FIGS. 12, 13, and 14 such a pin contact 100 having a contact body 102 and a band contact element 104. Similar to the socket contact body 40, the pin contact body 102 is stamped from a strip 44 of copper or some other suitable contact material in the usual manner. The contact body 102, after stamping, is rolled to form a pin portion 106 at one end thereof and formed to yield wire and insulation crimping tabs 48 and 50, respectively, at the opposite end. The pin portion 106 includes the recess 52 for receiving the arms 54 of the retaining collet. As best seen in FIG. 12, the pin portion 106 has a seam 108 where opposite edges of the stamped contact body 102 abut. As shown in FIGS. 11 and 13, four protrusions 110 are equally spaced about the longitudinal axis 112 near the end 114 of the pin portion 106. Similarly, four protrusions 116 are equally spaced about the axis 112 but spaced from the protrusions 110 so that the band contact element 104 will fit therebetween, as shown in FIG. 14. The protrusions 110 and 116 extend outwardly from the outside diameter or surface 118 of the pin portion 106. As with the protrusions 66 and 68 in the socket contact, the protrusions 110 and 116 have mutually opposing vertical or near vertical walls 120 and 122, respectively, and the protrusions 110 have opposite inclined surfaces 124 similar to the inclined surfaces 66. The opposed walls 120 and 122 are spaced so that the band contact element 104 fits therebetween with a small amount of end play to accommodate a slight amount of expansion when the pin contact is mated with a socket contact. The band contact element 104 is assembled to the pin contact body 102 by sliding the band over the end 114 so that it rides up the inclined surfaces 124, thereby expanding the band contact element slightly so that it passes completely over the protrusions 110. When the band contact element completely passes over the protrusions 110, it contracts, snapping around the pin portion between the vertical walls 120 and 122 and into electrical engagement with the surface 118. Alternatively, the band contact element may be assembled to the pin contact body with the aid of a tool similar to a tube or hollow cylinder, not shown. The band contact element is slipped over the outer diameter of the tool which is then arranged in abutting engagement with the inclined surfaces 124. The outer diameter of the tool is sufficiently large so that the band contact element, when slipped off the end of the tool will pass over the protrusions 110 and into electrical engagement with the surface 118.

The protrusions 110 and 116 are made in a manner similar to the protrusions 66 and 68 by forming indents 126 and 128 in the inner surface of the contact body 102 with a punch while supporting the outside surface 118 with a mating die, in the usual manner, to cause the protrusions to extend from the surface 118. This operation is most easily done during the stamping operation when the contact body is blanked from the flat strip stock 44 and prior to the rolling operation. The walls 120 and 122 may, if desired , be sheared completely through in the area indicated at 130 in FIG. 14, or the metal may simply be upset but remain contiguous. Other suitable stamping and forming operations may be employed to form the protrusions 110 and 116 that do not require the forming of the indentations 126 and 128. Such protrusions are considered within the scope of the present invention. The most important requirement is that the protrusions be suitably spaced and have near vertical opposing walls 120 and 122, and it is advantageous that the protrusions 110 have inclined surfaces 124 to aid in assembling the band contact element 104 to the contact body 102.

An important advantage of the present invention is that a connector contact body is manufactured by less expensive stamping and forming means while including retaining means for receiving and securing the band contact element to the contact body.

We claim:

1. In an electrical connector, an electrical contact comprising:

a stamped and formed contact body having plurality of retention features stamped and formed therein; and a band contact element in electrical engagement with a first surface of said contact body and held captive thereto by said retention features, wherein each of said retention features comprises, a protrusion extending from said first surface, the protrusion having an abutting wall facing said band contact element and an opposite wall facing away therefrom, and further wherein, each said protrusion has been formed by a stamping and forming operation, and each said protrusion has been sheared from said contact body so that said abutting wall comprises a sheared surface extending from said first surface.

2. The contact according to claim 1 wherein said opposite wall is inclined with respect to said first surface so that when said band contact element is assembled to said contact body said element engages said opposite wall and is deflected over said retention feature.

3. The contact according to claim 1 wherein said contact body includes at least two said protrusions having their respective abutting walls mutually opposed and wherein said band contact element is disposed between said abutting walls.

4. The contact according to claim 1 wherein said retention feature of said contact body includes a rolled edge at one end extending from said first surface and at least one said protrusion spaced from said rolled edge, wherein said band contact element is disposed between said rolled edge and said protrusion.

5. The contact according to claim 1 wherein said band contact element is of generally cylindrical shape having opposite ends that oppose respective ones of said abutting walls.

6. The contact according to claim 1 wherein said first surface is the outer cylindrical surface of a pin contact.

7. The contact according to claim 1 wherein said first surface is the inner cylindrical surface of a socket contact.

8. An electrical connector comprising: a conductive band contact element for establishing a disconnectable electrical connection between separable mating contact bodies, the contact bodies being a male contact body and a female contact body receiving the male contact body, the contact element being concentrically retained between first and second groups of protrusions on one of said contact bodies, a housing in which said one of said contact bodies is mounted, said protrusions terminating in respective walls facing respective opposite ends of said band contact element to retain said contact element between said first and second groups of protrusions, said one of said contact bodies having been indented to project said protrusions of the first group outward from a remainder of said one of said contact bodies, and each of said protrusions of the first group comprises, an inclined surface over which and past which the band contact is moveable to become positioned between said first and said second groups of protrusions.

9. An electrical connector as recited in claim 8, and further comprising: said respective walls having been sheared from said remainder of said one of said contact bodies.

10. An electrical connector as recited in claim 8, wherein said one of said contact bodies is the male contact body.

11. An electrical connector as recited in claim 8, wherein said one of said contact bodies is the female contact body.

12. An electrical connector as recited in claim 8, wherein said protrusions project from an outer surface of the male contact body.

13. An electrical connector as recited in claim 8, wherein said protrusions project from an inner surface of the female contact body.

14. An electrical connector comprising: a conductive band contact element for establishing a disconnectable electrical connection between separable mating contact bodies, the contact bodies being a male contact body and a female contact body receiving the male contact body, the contact element being concentrically retained between a rolled edge and a group of protrusions on one of said contact bodies, a housing in which said one of said contact bodies is mounted, said protrusions terminating in respective walls facing an end of said band contact element to retain said contact element between said rolled edge and said walls, said one of said contact bodies having been indented to project said protrusions outward from a remainder of said one of said contact bodies, and said respective walls having been sheared from said remainder of the of said one of said contact bodies.

15. An electrical connector as recited in claim 14, wherein said one of said contact bodies is the male contact body.

16. An electrical connector as recited in claim 14, wherein said one of said contact bodies is the female contact body.

17. An electrical connector as recited in claim 14, wherein said protrusions project from an outer surface of the male contact body.

18. An electrical connector as recited in claim 14, wherein said protrusions project from an inner surface of the female contact body.

* * * * *